US005724895A

United States Patent [19]

Uppstu

[11] Patent Number: 5,724,895

[45] Date of Patent: Mar. 10, 1998

[54] DEVICE FOR DISTRIBUTION OF OXYGEN-CONTAINING GAS IN A FURNACE

[75] Inventor: Erik Uppstu, Siivikkala, Finland

[73] Assignee: Oy Polyrec AB, Tammerfors, Finland

[21] Appl. No.: 436,477

[22] PCT Filed: Nov. 18, 1993

[86] PCT No.: PCT/FI93/00488

§ 371 Date: May 23, 1995

§ 102(e) Date: May 23, 1995

[87] PCT Pub. No.: WO94/12829

PCT Pub. Date: Jun. 9, 1995

[30] Foreign Application Priority Data

Nov. 23, 1992 [FI] Finland ..... 925305

[51] Int. Cl.[6] ..... F23G 7/04

[52] U.S. Cl. ..... 110/238; 110/251

[58] Field of Search ..... 432/99; 110/251, 110/238, 297

[56] References Cited

FOREIGN PATENT DOCUMENTS

| | | | |
|---|---|---|---|
| 85187 | 11/1991 | Finland . | |
| 59-205514 | 11/1984 | Japan | 110/251 |
| 149854 | 2/1955 | Sweden . | |
| 467741 | 9/1992 | Sweden . | |

*Primary Examiner*—Noah P. Kamen
*Attorney, Agent, or Firm*—Browdy and Neimark

[57] ABSTRACT

This invention is directed to an arrangement and a device for distribution of oxygen-containing gas (air) in a furnace, into which fuel is supplied as solid or fluid particles (1). The fuel consists of e.g. spent liquor from the pulp industry. Said liquor burns partly as char (2) on the floor (3), and partly as suspended particles and as volatiles. Horizontal rows of gas jets (4) activate the char burning on the floor. Vertically extended configuration of gas jets (5) higher up induces strong horizontal gas circulation but reduces vertical flow extremes. The improved horizontal mixing increases burning stability, capacity and energy efficiency, but reduces emission of $SO_x$, $NO_x$ and TRS. Lowered vertical recirculation permits better concentration of burning in the lower furnace and less carry-over of fuel particles.

6 Claims, 5 Drawing Sheets

DEVICE FOR DISTRIBUTION OF OXYGEN-CONTAINING GAS IN A FURNACE

BACKGROUND OF THE INVENTION

1. Field of the Invention

The invention relates to an arrangement and a device for distribution of oxygen-containing gas in a furnace, into which fuel is supplied as solid or fluid particles of such size and quality .that their trajectories are affected by gas flows. The oxygen-containing gas may be air, odorous gases (which will be converted to environmentally compatible gas in the combustion process) or flue gas. The intention is to establish such a flow pattern that intensifies the combustion process. As a typical application the invention relates to combustion of waste or residual products from pulp production.

2. Description of the Related Art

For the sake of clarity, the combustion of spent liquors from pulping processes utilizing organic fibrous material will be dealt with in the following. It shall not, however, be considered that the invention is limited to this particular area alone.

Spent liquors from pulping processes contain organic material which produces energy when burned and, additionally, inorganic chemicals, mainly sodium salts.

The spent liquor is sprayed into the furnace of the so-called black liquor recovery boiler with one or more liquor sprayers, which disperse the liquor into droplets of different size. Oxygen-containing gas—usually air—is in somewhat more than stoichiometric amount supplied into the furnace through special wall openings, so-called air ports. These air ports are usually arranged on three levels called primary, secondary and tertiary. Each of these levels consists of one or, sometimes, two (one lower and the other higher) horizontal or almost horizontal rows. Air or other oxygen-containing gas mixtures are fed into the air ports from one or, sometimes, two approximately horizontal ducts.

The function of the separate levels is explained in somewhat different ways. One of the most common explanations is presented below. The lowest level, i.e. primary, affects the so-called char bed on the furnace floor (2). The bed contains solid residues of the organic content of the fuel and the inorganic material which melts and flows out of the furnace.

The primary air oxidates the char, providing heat necessary for both melting of the inorganic salts and chemical reduction of sulphur into sulphide. The latter reaction is necessary to make sulphur recovery possible in a kraft pulping process. The area in which the drying and pyrolysis of the liquor droplets take place is provided with necessary oxygen from the secondary level. The ports for this air are usually located below the liquor sprayers. In boilers with a split secondary level, the upper level is sometimes located above the liquor sprayers.

Tertiary air burns out those combustible gases from fuel pyrolysis, which still are available in gases above the secondary air level. The tertiary ports are usually located on one level. Patent publication FI 85187, however, sets forth an application in which the secondary air ports are located on two levels. The patent application SE 467741 sets forth that "in the future, additional air supply over the tertiary level may be realized".

Kinetic energy of the supplied oxygen-containing gas is of importance. The primary and, to a certain extent, also the secondary flows affect the gas layer nearest the bed surface and consequently its burning. Secondary and tertiary air are given a high velocity in order to secure good mixing of oxygen with combustible gases. Besides, the jets often produce very complicated, stable or unstable flow patterns, which provide changing combinations of both favorable and unfavorable results.

Generally particle firing requires good mixing of oxygen-containing gas with fuel. Conveyance of fuel into the upper part of the furnace is not desirable. Combustion must take place rapidly and completely and, preferably, under a clearly stoichiometric oxygen deficit. Thus reduction or even entire removal of $NO_x$ (nitrogen oxides) in the flue gas would be achieved.

In this specific case concerning spent liquor combustion, more difficulties arise. The heat value of the spent liquor is usually very low, which results in unstable combustion. The fuel also contains a lot of sulphur, which often results in high $SO_x$ (sulphur oxides) in flue gas and in fly ash which is sticky and easily sinters into hard deposits on the heat transfer surfaces after the furnace. In boilers in which liquor with a particularly high sulphur content is burned, the pH of the deposits becomes so low that corrosion, under certain conditions, will develop very rapidly. It has also been established that the pyrolysis of liquor at low ambient temperatures leads to high sulphur emission and vice versa. Unstable combustion (with a low temperature) results in both a higher $SO_x$ content and more rapid formation of deposits and plugging problems among the heat transfer surfaces.

The flue gas temperatures at the furnace outlet restricts the capacity and availability of most boilers. Fly ash becomes sticky because of incipient melting at a given temperature, which depends on the actual chemical composition of the fly ash. In this case, deposits will develop rapidly; first, the deposits impair heat transfer and, later, result in plugging which prevents the flow-through of the flue gases.

Imbalance of the temperature profile at the furnace outlet further adds to the above-mentioned problems. The hotter side displays rapid plugging, which will gradually spread over the entire cross-section, and the production must be discontinued for cleaning.

Existing boilers at a number of plants are bottle necks in production. Thus their capacity must be increased. The environmental requirements are becoming increasingly stringent, which means that the performance expectations for both existing and new boilers increase. For economical reasons, new units are made increasingly large, requiring so large furnaces that the construction becomes difficult. Difficulties with the process also arise. The large units require higher combustion air velocities to produce sufficient mixing, which leads to greater carry-over of fuel particles. Making the combustion process essentially more efficient would considerably reduce the above-mentioned problems.

The disadvantages of the conventional air distribution (horizontal rows of air inlet ports over the entire width of the furnace) are described in the article "Alternative Air Supply System", Pulp & Paper Canada 92:2 (1991).

Gas jets from the inlet ports (6) on the adjacent walls join into diagonal flows (7) directed from each corner of the furnace. When meeting in the central region (8) of the furnace, the diagonal flows deflect upwards to a strong central core (9), whereas along the walls a downward gas flow (10) develops. The volume of the downward flow further increases the total gas quantity flowing upwards in the center. Computer simulations and measurements in current boilers have shown that the velocity in the central core can rise even to 16 m/s in cases where the average gas velocity is 4 m/s.

In order to fight the above-mentioned, today well-known tendencies, a number of modified arrangements of air supply have been proposed.

The patent publication SF 85187 and patent applications SF 87246 and SE 467741 can be mentioned as examples. Disadvantages of the conventional air distribution, which still encumber the solutions according to the above-mentioned publications, are due to the horizontal rows of gas jets located very low in the furnace. The rapid vertical flows which develop then lead to heavy mixing in the vertical direction, i.e. strong horizontal but weak vertical gradients. Consequently, a considerable vertical elongation of the area with a high temperature and a high content of suspended particles and burning gases forms. Practice requires quite the opposite. Maximum concentration of combustion and heat transfer lowest in the furnace, rapid cooling of upwards flowing gases and rapid burn-out of combustibles without fuel carry-over are necessary.

SUMMARY OF THE INVENTION

A gas jet flowing into the furnace through a port (6) sucks and carries ambient gas (11) along with it. Consequently the gas flows from all directions along the wall towards the port (jet). If several inlet ports are located near each other in a horizontal row (as in furnaces of conventional design), the jets form one resultant flat and horizontal jet. This jet will cause a long flat recirculation flow (10) parallelly with the wall from above and another from below. Actually, no considerable horizontal suction flows between the air inlet ports are possible, because each adjacent jet sucks in the opposite direction.

Fundamentally, the invention in this patent is based on the conventional construction being turned 90 degrees. A few vertical rows with a large—compared to the conventional number of levels—number of ports in each row are obtained. So the flow pattern in the furnace also turns 90 degrees. The long recirculation flows will work horizontally, while vertical flows, except the net upward flow, are effectively cut by the large number of vertical jets. Instead of vertical mixing with vertically equalized temperatures and concentrations, the arrangement obtains efficient horizontal mixing. This feature gives considerably clearer horizontal layers where each layer is remarkably thinner than those in conventional systems. Consequently stronger vertical gradients in terms of both temperatures and composition are obtained.

If the number of jets in the vertical rows further increases, the height of each layer decreases, until a fully stepless system with an infinite number of jets forms. An entirely continuous, vertical and flat jet represents this limit value. In a practical application, one single inlet port, which is very high and narrow, forms this jet. In this case it is irrelevant to speak of separate levels in the area in question.

Thanks to the more efficient horizontal mixing, the supply of air into the lower part of the furnace can be reduced, although combustion is increases in said region. More benefits are obtained, because air excess can be considerably reduced. A smaller excess air flow provides higher temperatures in the lower part of the furnace, stabilized combustion, smaller quantities of $NO_x$ and $SO_x$ and a smaller net flow of flue gases upwards. The reduced flow further moderates the carry over tendencies.

If located near each other, two or more jets in approximately the same direction merge into each other and flow as one larger single jet. Therefore jets referred to in this patent can derive from a group of adjacent inlet ports.

The present invention is not intended to cover the (two) lowest air levels, if any, which can directly affect a char bed on the furnace floor.

The present invention utilizes at least partly vertical systems in supplying the ports with oxygen-containing gas instead of approximately horizontal ducts of conventional design. Besides less complicated and thus more cost-effective designs, more simplified and efficient process control is also achieved. Separate vertical sections, of each of which is formed of several gas jets arranged above each other, are therefore separately controllable. Asymmetric temperature or concentration profiles in the furnace cross-section, for example, can be corrected easily by changing the pressure of gas supplied to said section, without jeopardizing the vertical balance between the individual jets.

Colliding gas jets strengthen vertical flows. Thus collisions must be avoided the jets should be non-colliding. If inlet ports are located in adjacent walls, in the front and the side wall, for example, the jets cross each other. In that case one gas jet must be located so that it passes above or below the other. If jets start only from opposite walls, the flow pattern can be further improves when the meeting jets by-pass each other laterally and/or vertically. If said opposite walls are a front and a rear wall, the important side geometry of the furnace can be easily controlled.

The cross-section of the gas jets increases rapidly after the air jet leaves the port. Therefore the jets from opposite walls must be located sparsely, allowing in one approximately square cross-section no more than three jets per wall and level for best results. If the left-right symmetry is to be maintained, this means that one of the opposite walls will have only one or two jets and the other two or three jets. A pattern symmetrical in both left-right direction and in front-rear direction is also possible with following arrangement (FIG. 6).

This is effected by installing either one or two jets per wall from opposite walls applying the previous principle of avoiding collision, so that the mirror image of the equipment on one wall is symmetrical with the equipment on the opposite wall. The effect of this arrangement—which is asymmetrical when only one level is considered—can be balanced by designing every other level according to its mirror image, when the imaginary vertical mirror level is set through the centerlines of the walls in question.

In other words:

- at some of the elevations a few jets (13, 23) from opposite directions apply the previous methods of avoiding collisions;
- a first jet configuration of one elevation is asymmetrical so that, the image of the jets substantially coincide with said jets, when the image rotates horizontally 180 degrees around the center (26) of the furnace;
- a second configuration is a mirror image of said first configuration;
- said first and second configurations alternate at consecutive elevations;

The equipment around the furnace and ergonomics may benefit if the levels for the jets of one wall are located approximately in the middle between the elevations of the opposite walls.

DESCRIPTION OF THE PREFERRED EMBODIMENT

As an application example of the invention, a large black liquor recovery boiler can be designed as follows: One or two of the lowest levels for the supply of oxygen-containing gas are made horizontal or somewhat inclined rows of gas jets. Above these rows, jets in vertical rows are located so that three rows start from the front wall and two from the rear wall. To avoid collisions between opposite jets, one of the front wall rows is located on the center line, one at a small distance from the left corner, and one at the same distance from the right corner. The rear wall rows are located laterally midway between the front wall rows.

Figure 1:
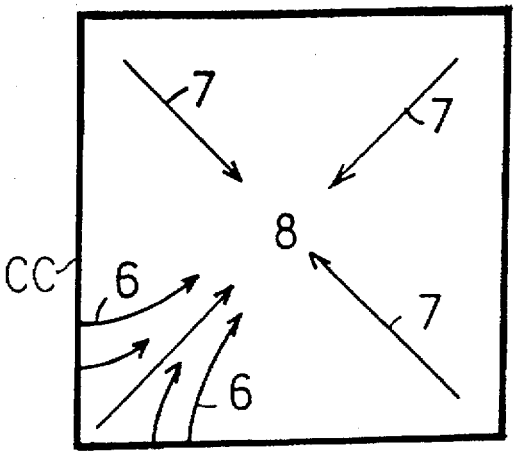
FIG. 1 shows a horizontal cross-section of a furnace with conventional supply of oxygen-containing gas. Jets (6) which are located on the same level, join in the corners to form a flow (7), which flows diagonally towards the centre of the furnace (8). Here the diagonal flow collides with similar flows from the other three corners and turns upwards, forming a strong, vertical core (9). The same process is shown in FIG. 2, where vertical recirculation (10) and material (2) containing char and inorganic matter on the furnace floor are also shown.
Figure 2:
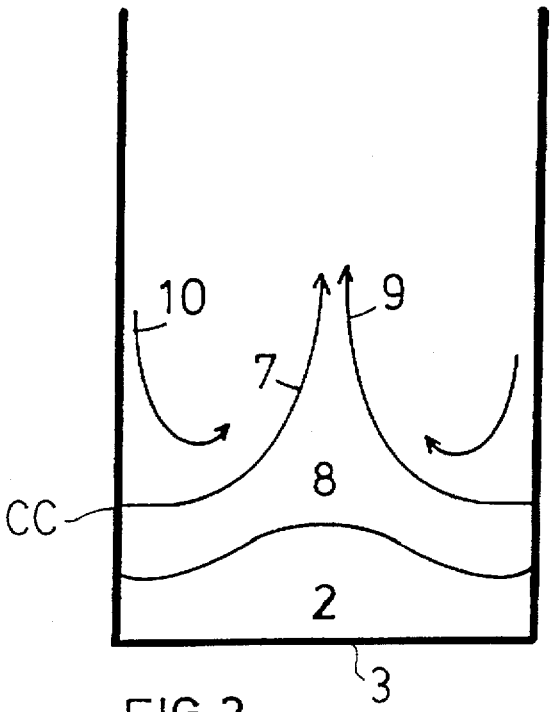
Figure 3:
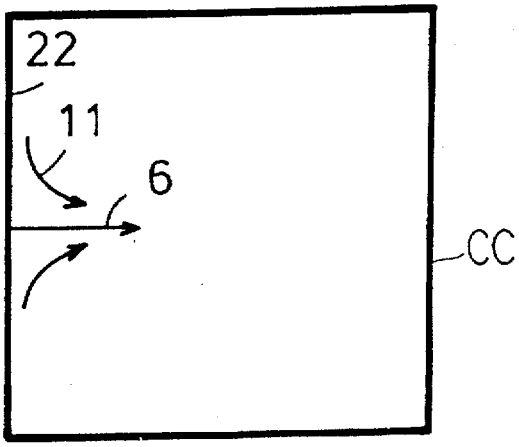
FIG. 3 is a horizontal section of a furnace, showing how a jet which enters through an inlet port (6) in the wall (22) carries with it gases from the surroundings in the form of recirculation flows.
Figure 4:
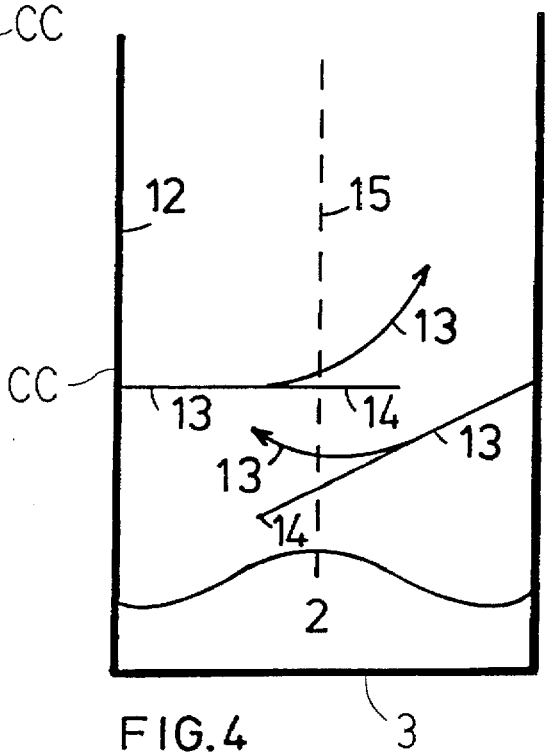
FIG. 4 is a vertical section of a furnace with material (2) on the floor and with two opposite walls (12) from which jets (13) point so that they or their extensions (14), without colliding with each other, meet the imaginary level (15) parallelly with and in the middle between the opposite walls.
Figure 5:
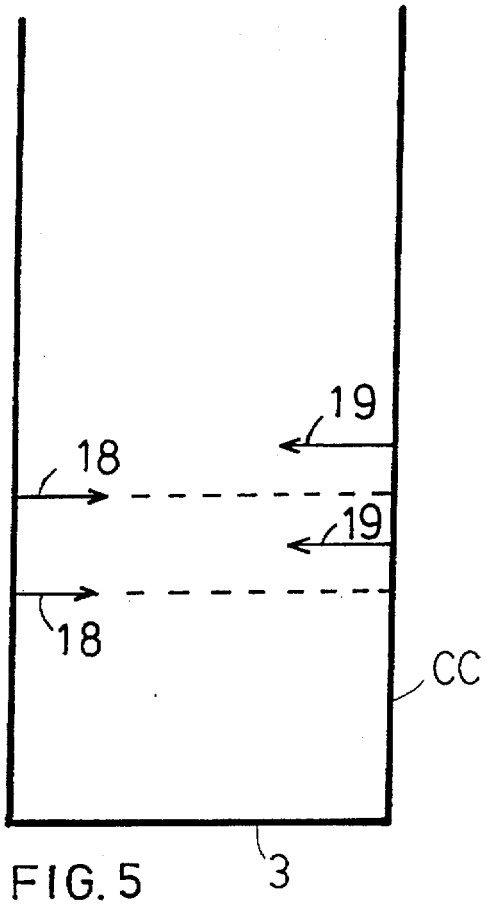
FIG. 5 is a vertical section showing how the jets (18) of one wall are located at an elevation which lies midway between the elevations of the jets (19) from the opposite wall.
Figure 6:
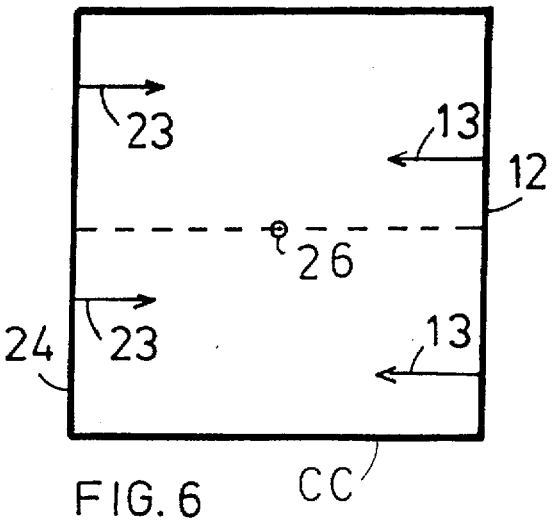
FIG. 6 shows jets with a laterally asymmetrical arrangement in the horizontal section of a furnace.
Figure 7:
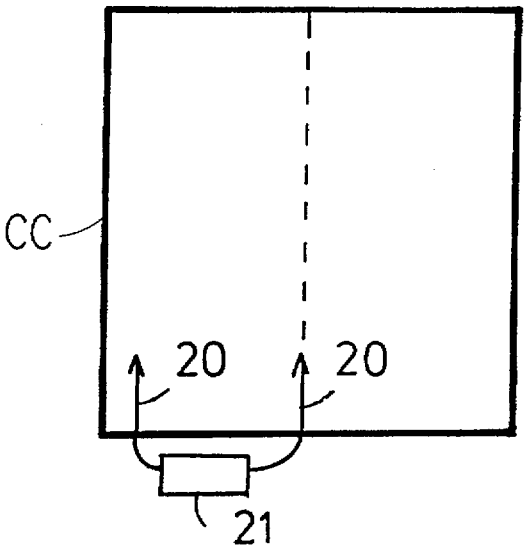
FIG. 7 shows, in a horizontal section of a furnace, supply of oxygen-containing gas from a duct (21) to jets (20) in the area between the furnace corners (18) and center line (19), with the center line proper (19) included in the area.
Figure 8:
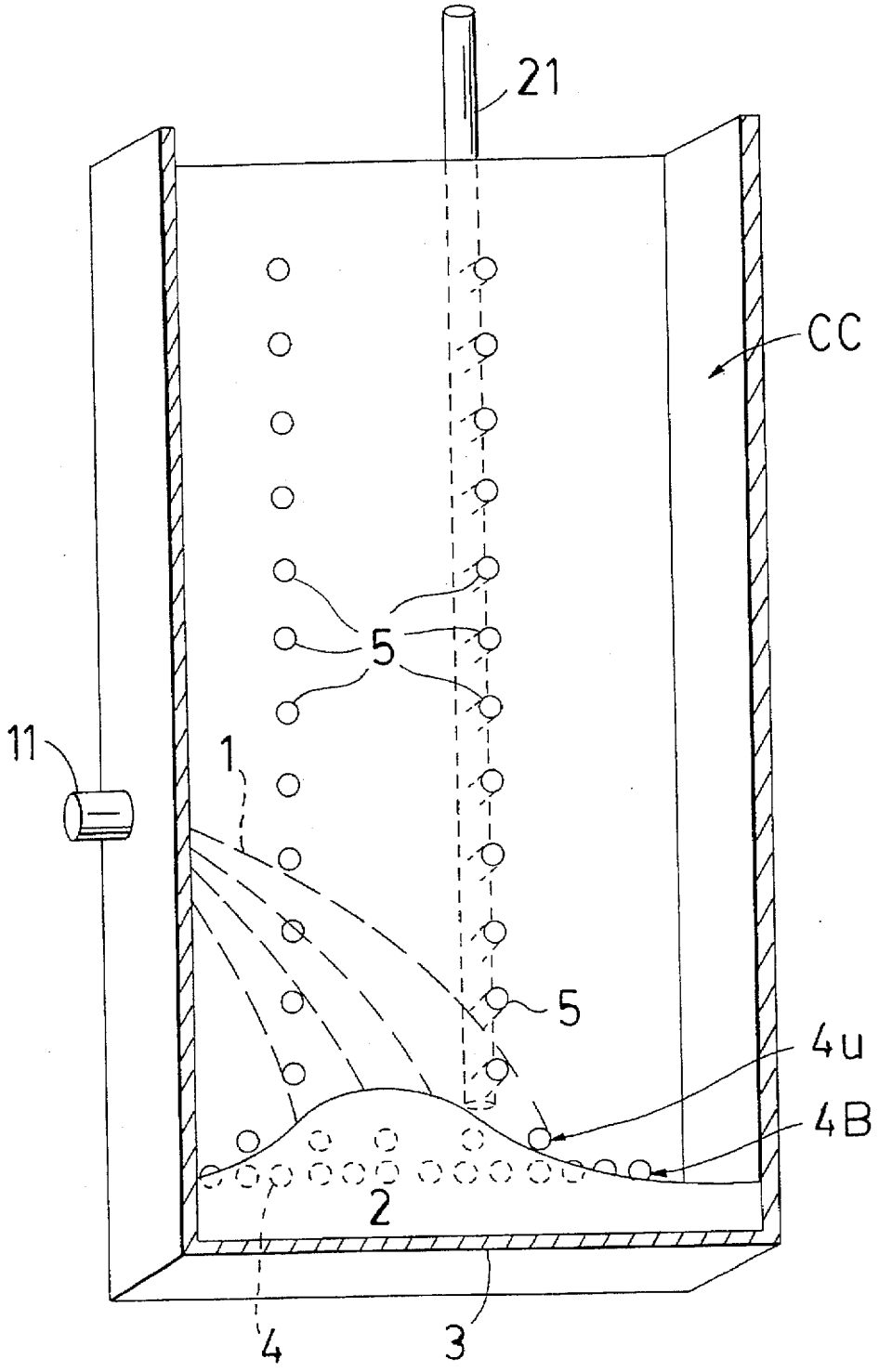
FIG. 8 is a perspective view illustrating locations of jets originating from one wall of a furnace.

More specifically: Referring to FIG. 8 (a vertical section), the combustion chamber CC includes a floor 3, a horizontal row of jet inlets 4, and two vertical rows of jet inlets 5. The inlets 4 comprise in FIG. 8 an upper-elevation row 4U and a lower-elevation row 4B. The one or two lowest levels for the supply of oxygen-containing gas, the inlets 4, are not only arrayed in horizontal rows but are also aimed horizontally or else are somewhat angled to produce inclined rows of gas jets.

A liquor sprayer 11 produces a spray 1.

A vertical supply duct or header 21 is shown in FIG. 8, which supplied oxygen-containing gas to the vertical-group jet inlets 5.

Figure 11:
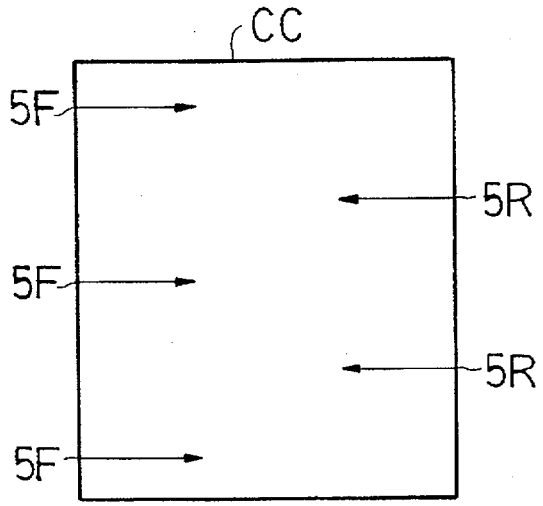
FIG. 11 is a laterally symmetrical jet arrangement with five jets.
Figure 9:
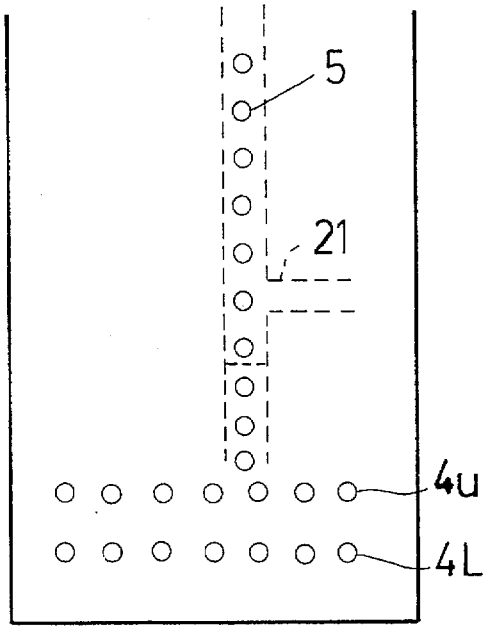
FIG. 9 is an elevational view of the present invention showing an inclined lower row.
Figure 12:
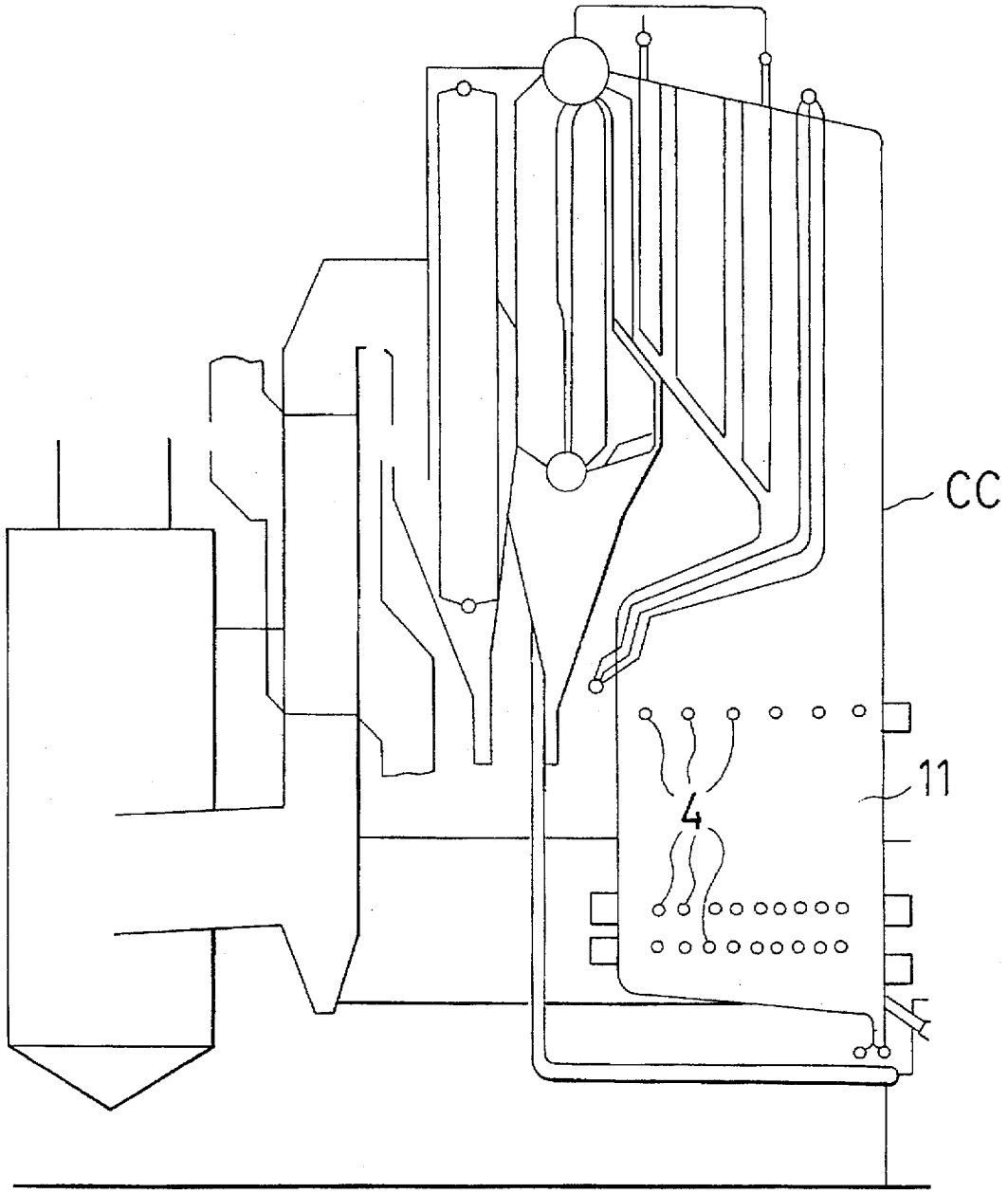
FIG.12 (PRIOR ART)
FIG. 12 shows a typical prior-art furnace in cross section. Horizontal rows of gas jets are visible.

Referring to FIG. 11 (a horizontal section), above the rows 4 the jet inlet vertical rows 5 may be located so that three rows 5F start from the front wall and two rows 5R from the rear wall.

The level of the lowest (horizontal) jet row is at a height of 1.5 m above the center of the furnace floor.

The distance between the levels of jets in the vertical rows is 1.5 m until about 0.5 b from the furnace outlet, where b=furnace width. This means that in a 30 m high and 12 m wide furnace has about 14 jets in each vertical row.

The jets in the vertical rows differentiate so that the three lowest jets come from inlet ports with a larger cross-section and are supplied with air at a lower pressure than the remaining ports above. The jets in the vertical rows take their oxygen-containing gas from likewise vertical ducts, one duct for each row. The inlet ports in the middle row of the front wall, however, get their gas alternately from the ducts of the left row and the right row.

All elevations (inlets 4, 5), except the next lowest one, have slightly downwards directed air jets.

Figure 10:
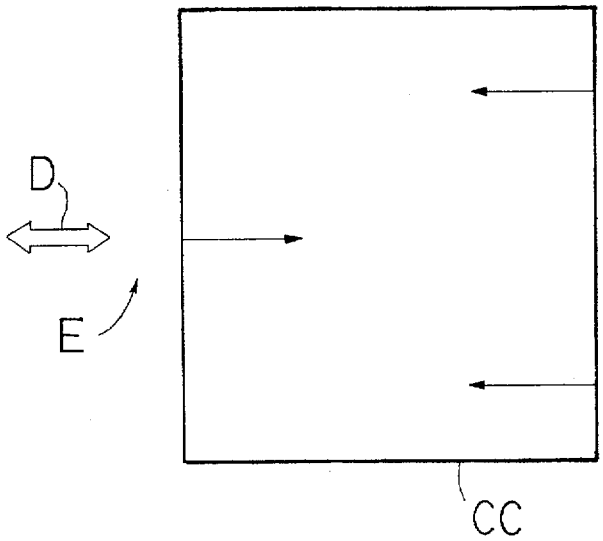
FIG. 10 is a laterally symmetrical jet arrangement with three jets.

FIG. 10 shows a direction arrow D indicating the front-rear or the deflection direction of the furnace gases at an exit E.

The present invention included cases in which the angle between the projection of the gas jets on the horizontal plane and the wall from which they are discharged deviates from 90 degrees. An arrangement in which the inlet ports laterally deviate so little that it has no considerable significance to the appearance of the flow pattern is also referred to as vertical rows.

In the present invention, preferably the height of the lowest jet exceeds one meter. The invention includes two higher jets at different elevations being supplied with gas from a common device. A common duct supplies oxygen-containing gas to at least one of said higher jets (openings) at each of two elevations. The angle between the center line of the common duct and the horizontal plane may exceed 45 degrees. At least one jet may be located above the elevations of lower gas jets, and the one jet may originate from a gas jet inlet opening whose vertical dimension exceeds 1 meter.

I claim:

1. In an arrangement for distribution of oxygen-containing gas jets in a furnace including a combustion chamber surrounded by flat walls on opposite sides of said combustion chamber, a floor, and means mounted above the floor for delivering solid or liquid fuel particles into said combustion chamber, said arrangement comprising a plurality of first gas inlet ports each comprising means for creating a respective oxygen-containing gas jet and disposed in at least one horizontal row, the improvement comprising:

means for increasing vertical stratification and decreasing horizontal stratification in the combustion chamber comprising additional gas inlet ports extending through at least two of said flat walls, said additional gas inlet ports being disposed at more than six different elevations above said first gas inlet ports and in a pattern of vertical spaced-apart rows with said additional gas inlet ports being spaced so as to be not in direct facing relationship with one another and so that jets of gas emerging from said additional gas inlet ports in said at least two flat walls avoid substantial direct collision, and wherein the number of said additional gas inlet ports at any single horizontal level is substantially fewer than said plurality of first gas inlet ports.

2. The arrangement according to claim 1, wherein at least one gas inlet port of said additional gas inlet ports is disposed at a vertical elevation exceeding 1.5 meters.

3. The arrangement according to claim 2, including a sloping row of said gas ports inlet openings.

4. The arrangement according to claim 1, wherein said combustion chamber has a substantially rectangular cross-section defined by four of said flat vertical walls, and wherein said at least two of said flat vertical walls through which said gas inlet ports extend are opposite facing vertical walls.

5. In a combustion air supply arrangement for a furnace which includes a combustion chamber defined by flat vertical walls and a floor, means mounted above the floor for delivering fuel into said combustion chamber, and a plurality of gas jet inlet ports for supplying oxygen-containing gas to said chamber to support combustion of said fuel, the improvement comprising:

said gas inlet ports extending through at least two of said flat vertical walls and being spaced so that jets of gas emerging from said gas inlet ports in said at least two flat vertical walls avoid substantial direct collision, said gas inlet ports in each of said at least two flat vertical walls being vertically spaced from one another at more than six different elevations, and said gas inlet ports at a lowest elevation in one of said flat vertical walls being disposed in a substantially horizontal row and including a greater number of said gas inlet ports than are present in an uppermost horizontal row of said six different elevations of gas inlet ports.

6. The arrangement according to claim 5, wherein said combustion chamber has a substantially rectangular cross-section defined by four of said flat vertical walls, and wherein said at least two of said flat vertical walls through which said gas inlet ports extend are opposite facing vertical walls.

* * * * *